US006460227B2

(12) United States Patent
Hove

(10) Patent No.: US 6,460,227 B2
(45) Date of Patent: Oct. 8, 2002

(54) LOCKING DEVICE FOR USE WITH STACKABLE SHIPPING CONTAINERS

(75) Inventor: John Hove, Jacksonville, FL (US)

(73) Assignee: Buffers USA, Inc., Jacksonville, FL (US)

( * ) Notice: Subject to any disclaimer, the term of this patent is extended or adjusted under 35 U.S.C. 154(b) by 0 days.

(21) Appl. No.: 09/747,941

(22) Filed: Dec. 27, 2000

(65) Prior Publication Data

US 2001/0052169 A1 Dec. 20, 2001

Related U.S. Application Data

(60) Provisional application No. 60/171,663, filed on Dec. 27, 1999.

(51) Int. Cl.[7] ..... A44B 21/00; B60P 1/64; B65D 21/02

(52) U.S. Cl. ..... 24/287; 24/455; 403/325

(58) Field of Search ..... 24/287, 455; 403/325

(56) References Cited

U.S. PATENT DOCUMENTS 3,691,595 A * 9/1972 Backteman ..... 24/287
3,752,511 A * 8/1973 Racy ..... 24/287
4,277,212 A * 7/1981 Rosaia ..... 24/287
4,564,984 A * 1/1986 Takaguchi ..... 24/287
6,164,862 A * 12/2000 Takaguchi ..... 403/325
6,336,765 B1 * 1/2002 Watanabe et al. ..... 403/325

FOREIGN PATENT DOCUMENTS

GB 1217486 * 12/1970 ..... 24/287

* cited by examiner

*Primary Examiner*—Victor Sakran
(74) *Attorney, Agent, or Firm*—Browdy and Neimark, P.L.L.C.

(57) ABSTRACT

The invention is directed to a locking device which can be engaged in a conventional ISO aperture of a corner casting of an upper and lower shipping container stacked on a carrier to lock the containers together. The locking device has a housing having a compression pad with an upper and lower shear block. A spring-biased twist-head is engaged to the upper shear lock, and a spring-biased hook is engaged in the housing. When the upper and lower shear block of the lock are respectively engaged in the ISO aperture of the upper and lower corner castings of the stacked containers and the twist-lock and the hook are each in a closed position within the corner casting, relative movement between the containers is limited.

19 Claims, 5 Drawing Sheets

LOCKING DEVICE FOR USE WITH STACKABLE SHIPPING CONTAINERS

This application claims priority from provisional application 60/171,663, filed Dec. 27, 1999.

BACKGROUND OF THE INVENTION

1. Technical Field of the Invention

The invention is directed to a locking device for engagement between stackable shipping containers to lock the containers together, wherein the locking device is engaged in an upper and lower conventional ISO aperture of corner castings on the containers to arrest their relative movement.

2. Prior Art

Automatic container locks have been in use with stackable shipping containers for over 20 years. Both hook locks and twist-head locks that have been each separately welded down on a flatcar to engage a single container have been used during this period. Automatic locks have also been designed to work between vertically stacked containers. However, none of these provide a combined spring-biased twist-head and hook lock engaged between the stacked containers with a compression pad extending past the edges of the stacked containers to house means for operating the twist-head and an indicator to alert the operator whether the spring-biased hook is an open or closed position. Further, all prior art automatic locks designed to lock together stackable containers must be removed in the same position that they were engaged to the container corner castings. Accordingly, prior art locks must be removed from the top of the bottom container while positioned on the shipping carrier or from the bottom of the top container while on the ground.

OBJECT AND SUMMARY OF THE INVENTION

The primary object of the locking device according to the invention is directed to increasing an operator's flexibility for respectively engaging or removing a lock during the stacking or unstacking of containers on which the lock is used.

Accordingly, the locking device according to the invention permits an operator at a loading terminal to engage the lock to the bottom of the top container while the container is on the ground or to the top of the bottom container when on a carrier before the upper container is loaded. In addition, at a discharge terminal an operator can chose to remove the lock from the top container of a stack by releasing the twist-head from engagement with the top container, with the lock still engaged in the lower container when the top container is unloaded, or alternatively, the top container can be unloaded with the lock still engaged and thereafter removed.

When the lock has been left engaged in the lower container after unloading of the top container, the spring-biased lock can be removed from the lower container by manually lifting the lock up from the engaged corner casting the height of its lower shear block and turning it 90° in the corner casting to align the horizontal length of the hook with the longitudinal direction of the ISO aperture. This permits the lock to be further lifted up and completely disengaged from the corner casting without the need to compress the spring biased hook.

This flexibility allows operators at a loading terminal to do all lock engagement and removal on the carrier (stacked operation) and operators at an unloading terminal to do lock disengagement on the ground (wheeled operation) or vice versa.

This operational flexibility is achieved regardless of the original position in which the lock was fitted to the container enabling the operator at an unloading terminal to decide how to remove the lock instead of being required to pursue conventional practice. The invention also gives the operator an indicator showing the open or closed position of the hook that is clearly visible from the ground and from the platform at the end of the carrier. This is possible due to the extended compression pad that covers the container corner castings out past the side of the container. This extended load pad makes it also possible to direct the load force from the top container straight down into the stacking posts of the bottom container, thereby reducing the bending forces occurring with existing locks that have a compression load pad limited to surrounding the aperture hole of the engaged corner casting.

The lock according to the invention also gives the operator an alternative disengagement method in case the automatic lock malfunctions and does not open when the container is lifted. By pulling the handle operating the twist-head from the ground on the side of the carrier, the twist-head is turned to open, thus allowing the container to be unloaded in spite the malfunctioning hook side of the lock.

The operation and features of the lock according to the invention are further set out in the following drawings:

IN THE DRAWINGS

DETAILED DESCRIPTION OF THE PREFERRED EMBODIMENT OF THE INVENTION

Figure 1:
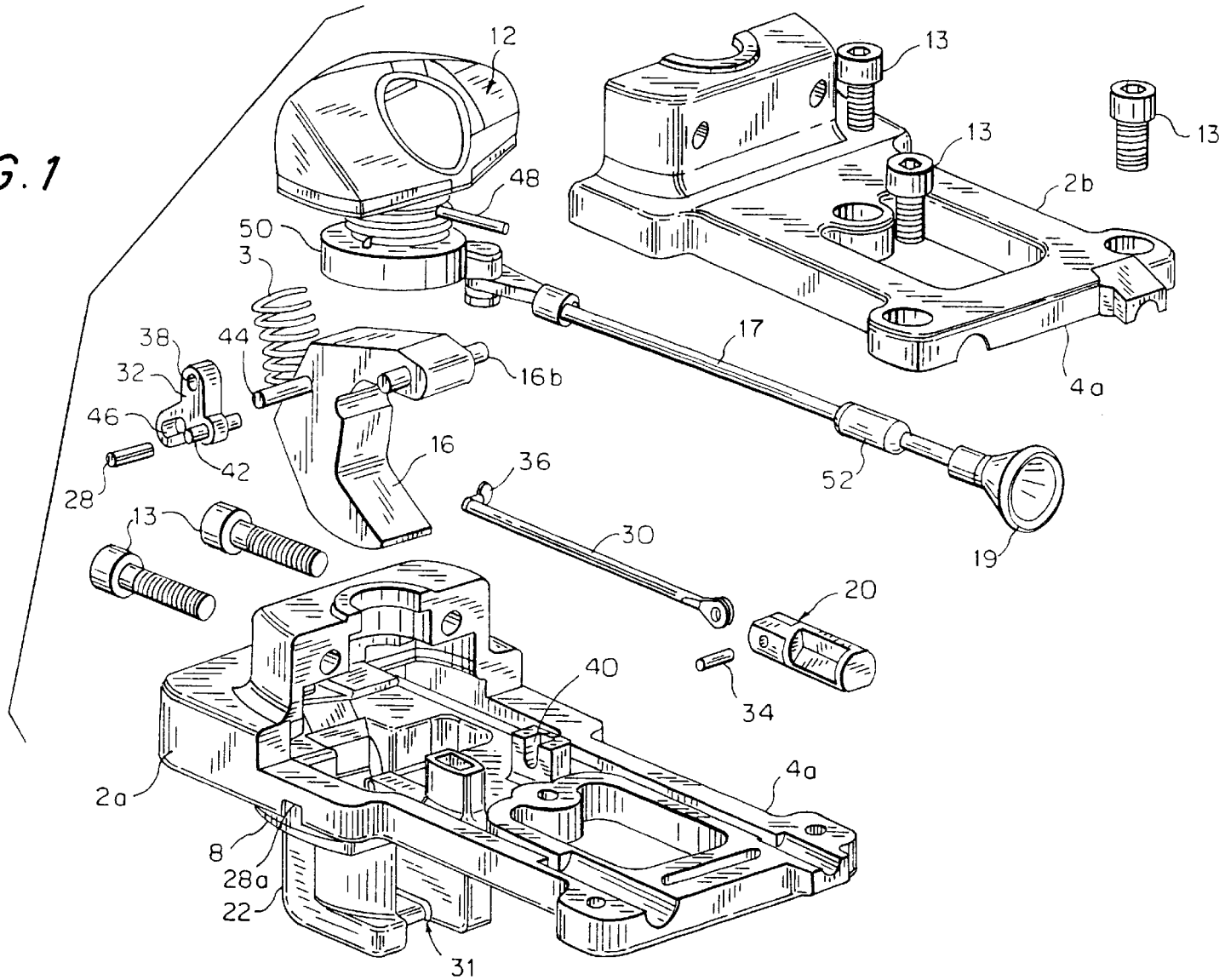
FIG. 1 shows an exploded view of the lock device according to the invention.
Figure 2:
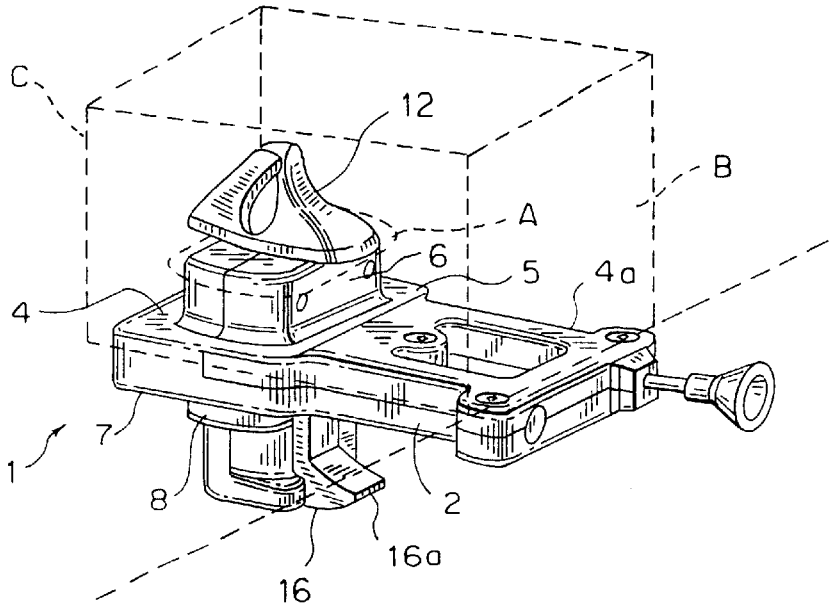
FIG. 2 shows a perspective view of the assembled lock device of FIG. 1 with the spring-biased twist-head in locked position within a corner casting of a shipping container.
Figure 6:
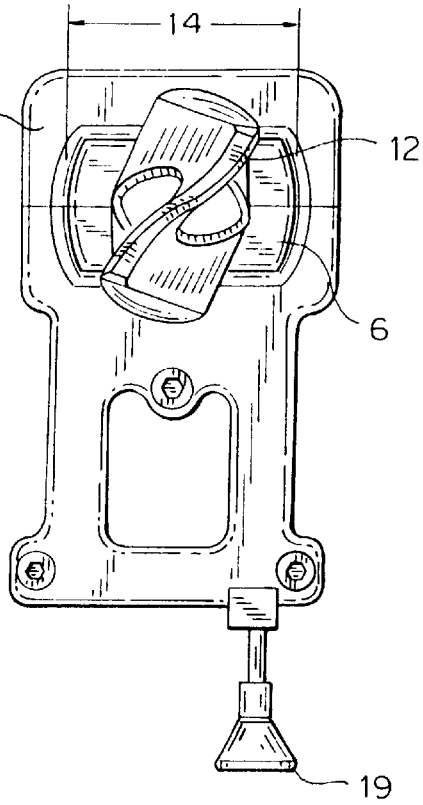
FIG. 6 shows a top view of the lock device of FIG. 3.
Figure 7:
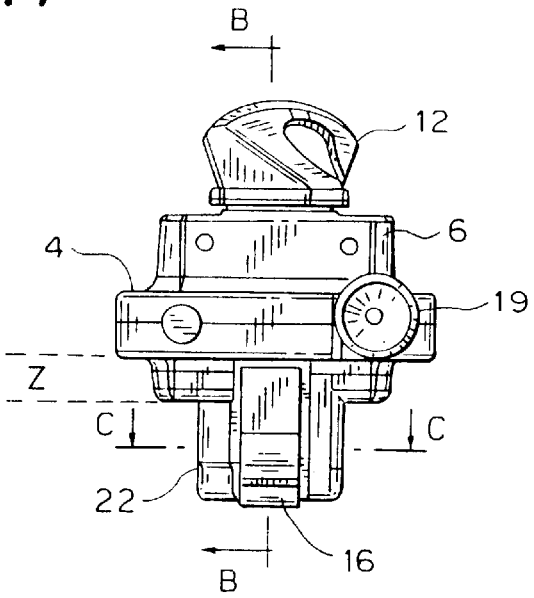
FIG. 7 shows a front view of the lock device of FIG. 3.
Figure 8:
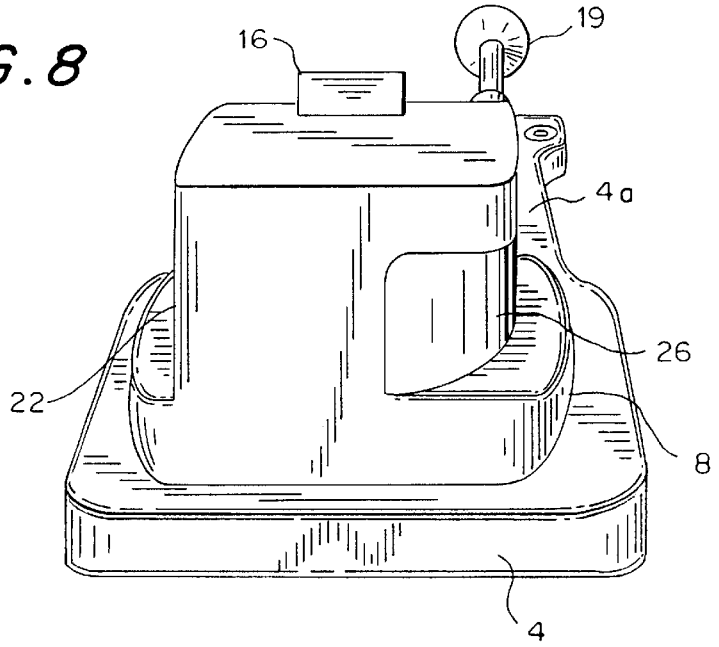
FIG. 8 shows a perspective back view of the lower shear block and hook.

As shown in FIG. 2, locking device 1 comprises a housing 2 when housing sections 2*a* and 2*b*, shown in FIG. 1, are joined together by bolts 13. Housing 2 is provided with a compression pad 4 on which upper and lower shear blocks 6, 8 are integrally formed. Both upper and lower shear blocks 6, 8 have a longitudinal length 14, best shown in FIG. 6, which corresponds to the longitudinal length of a standard ISO corner casting aperture A of a corner castings B of container C which can be stacked on carriers including rail cars. For purposes of clarity only upper container C with casting B having aperture A are shown in phantom lines on FIG. 2, it being understood that a top casting on a lower container casting B has an identical size aperture engaged around shear block 8 when the top container C is stacked with the lock on the lower container. When locking device 1 is engaged between the corner castings on an upper and lower container in a stack to limit their relative movement, the container corner castings engage the upper and lower surface 5, 7 of compression pad 4 while upper and lower shear blocks 6, 8 extend into and are engaged in corresponding apertures in corner castings of the upper and lower containers. Vertical movement of an upper container relative to a lower container engaged together by locking device 1 is limited by spring biased twist head 12 on the upper shear block 6 and spring biased hook 16 on lower shear block 8. With regard to hook 16, a free end 16*a* of the hook extends below an edge of the aperture in the corner casting engaged on the lower container. Both the twist head 12 and hook 16 are further discussed below.

In the preferred embodiment, the compression pad 4 projects as extended housing 4*a* past the edges of engaged corner castings. As shown in FIG. 1, extended housing 4*a* provides space within for a connection cable 17 between handle 19 and twist head 12 and an indicator rod 30 to connect hook 16 to indicator 20. Extended housing 4*a* also permits the compression force from stacking posts (not shown) on the widest used conventional container to go straight down through the stacking posts of a corresponding lower container thereby eliminating bending forces on the container corner castings.

Figure 4:
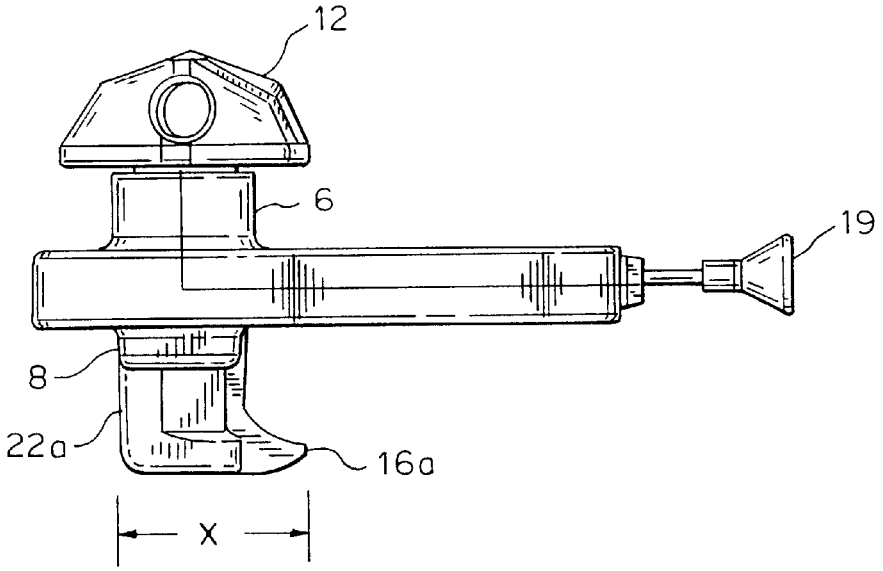
FIG. 4 shows a side view of the lock device according to the invention with the twist-head in closed position.
Figure 9:
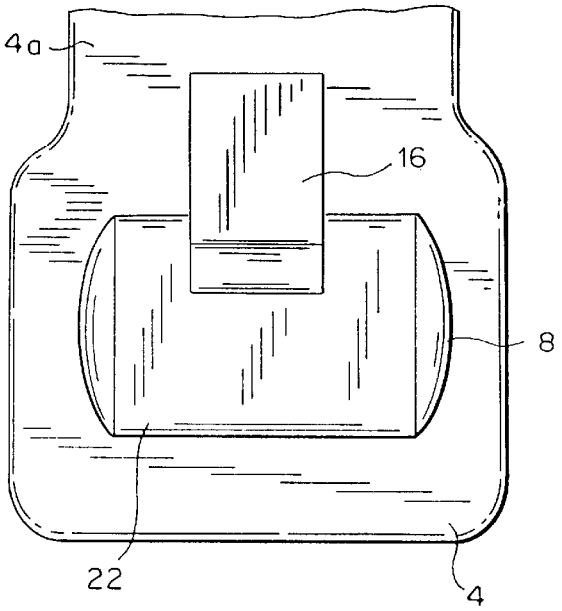
FIG. 9 shows a partial bottom view of the lock device of FIG. 3.
Figure 10:
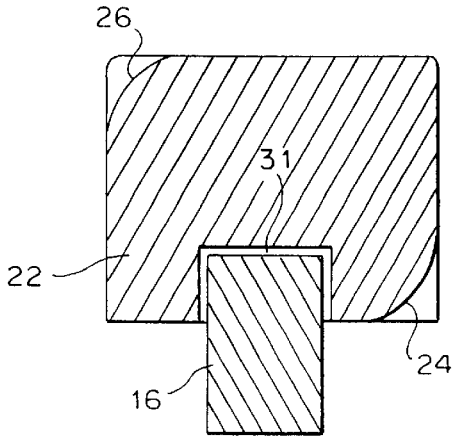
FIG. 10 shows a cross-section along section C—C of FIG. 7.

As shown in FIGS. 1, 4 and 9 a lower portion 22 of housing section 2*a* projects down and is integrally formed with lower shear block 8. Lower portion 22 has a length that is less than the (longitudinal) length of lower shear block 8. Lower portion 22 also has a width that is less than the width of the ISO aperture. In addition, diagonally opposite corners 24, 26 shown in FIG. 10 are respectively formed as segments of a circle or may be otherwise beveled allowing the lower portion 22 to turn inside the ISO aperture.

The spring-biased hook 16 is rotatably engaged by pivots 16*b* in bearings 40 in housing section 2*a* against spring 3. When hook 16 is fully extended out of slot 31 in lower portion 22 and shear block 8 by spring 3, free end 16*a* of hook 16 will project under the longitudinal edge of the aperture of the corner casting to which the locking device is engaged. In this position, a distance x shown in FIG. 4 from the distal side 22*a* of lower portion 22 to free end 16*a* is less than the longitudinal length of the aperture in the corner casting on which locking device 1 is engaged.

These dimensions and the shape and size of the lower portion 22 permits an operator to disengaged the lock device 1 from the corner castings to which it is engaged by first lifting the device 1 up from the casting a distance slightly greater than height Z of lower shear block 8 and then turning the device 1 approximately 90° to align a vertical plane through the length of hook 16 along the longitudinal length of the casting's aperture. Thereafter, the device can be removed from the casting without obstruction by the casting.

Figure 5:
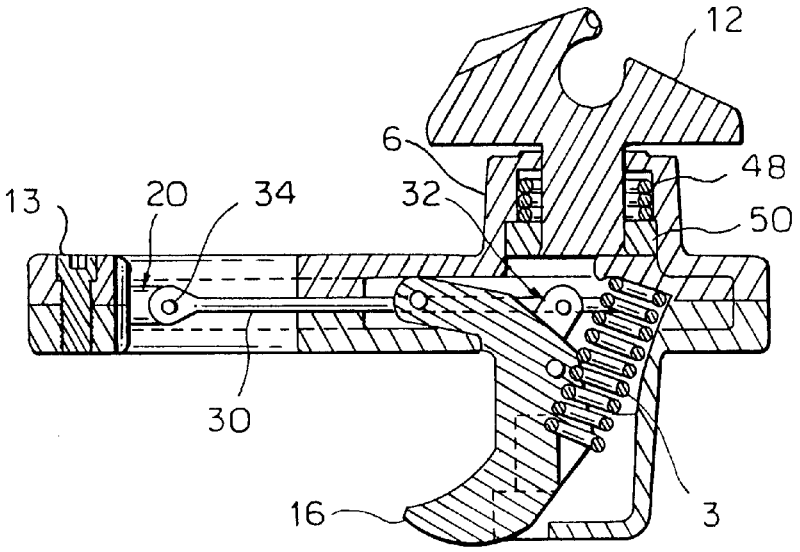
FIG. 5 shows a partial cross-section along section B—B of FIG. 4.

As shown in FIGS. 1, and 5 indicator 20 is engaged to hook 16 through indicator rod 30 and rotatable link 32 wherein indicator rod 30 is engaged at one end to indicator 20 by pivot 34 and to rotatable link 32 by insertion of a bent end 36 into through hole 38 of rotatable link 32. Rotatable link 32 is rotatably engaged on pivot 28 which has respective ends engaged in through hole 42 on link 32 and through hole 28*a* on housing section 2*a*. Further, fixed projection 44 on hook 16 is slidably engaged in slot 46 of rotatable link 32. When hook 16 is rotated by a force against spring 3, projection 44 slides in slot 46 and rotates link 32 clockwise to push indicator rod 30 and indicator 20 through extended housing 4*a* into the visible position shown in FIG. 3 outside extended housing 4*a* at the side of the stacked containers and indicates that hook 16 has moved from its closed to its open position.

Figure 3:
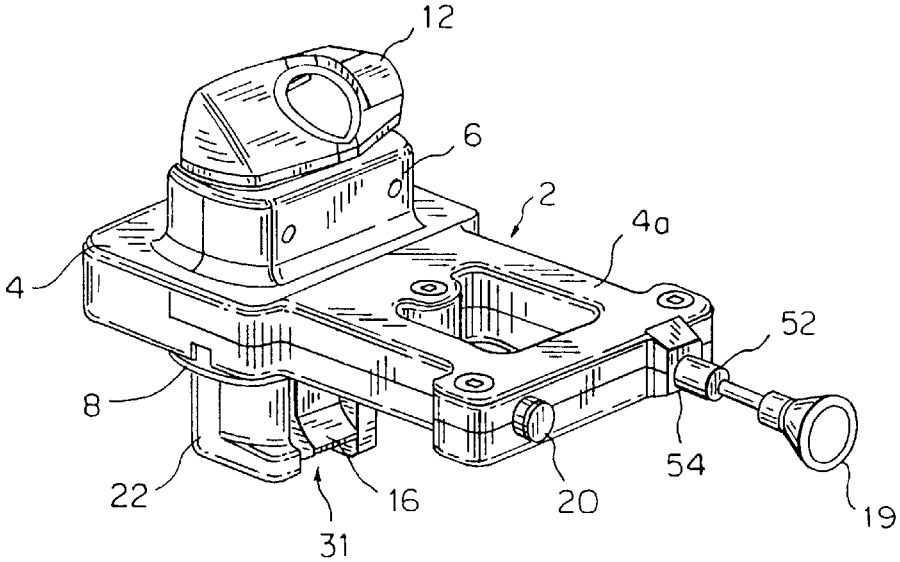
FIG. 3 shows a perspective view of the assembled lock device of FIG. 1 with the spring-biased twist-head and hook both in an open position.

On a top of upper shear block 6 spring-biased twist head 12 is rotatably engaged against spring 48 which maintains twist head 12 in the locked position shown in FIG. 2 when the lock device 1 is engaged to the bottom corner casting B of upper container C. Twist head 12 can be rotated from such locked position to the open position shown in FIG. 3 where the twist head can be disengaged through the aperture of the engaged casting. This is achieved by pulling cable 17 in extended housing 4*a* to rotate engaged twist lock base 50 against spring 48 when the operator pulls cable handle 19 away from the engaged locking device 1. The twist head 12 can be maintained in this open position as shown in FIG. 3 by inserting swage 52 in slot 54 of extended housing 4*a* when cable 17 is extended out of extended housing 4*a*.

The foregoing description of the specific embodiments will so fully reveal the general nature of the invention that others can, by applying current knowledge, readily modify and/or adapt for various applications such specific embodiments without departing from the generic concept, and, therefore, such adaptions and modifications should and are intended to be comprehended within the meaning and range of equivalents of the disclosed embodiments. It is to be understood that the phraseology or terminology employed herein is for the purpose of description and not of limitation.

What is claimed is:

1. A locking device adapted to be engaged in a conventional ISO aperture of a corner casting of an upper and lower shipping container stacked on a carrier to lock the containers together, the locking device comprising:

a housing having a compression pad and an upper and lower shear block fixed thereto;

a spring-biased twist-head engaged to the upper shear block rotatable in a horizontal plane against a first spring from a closed position to an open position, and a spring-biased hook engaged in the housing and rotatable in a vertical plane against a second spring from a closed position to an open position;

wherein the housing has a lower portion extending down from the lower shear block and the hook is rotatable through a slot in the lower shear block and the lower portion of the housing; and wherein the locking device can lock the containers together when the upper and lower shear block are respectively engaged in the ISO aperture of the upper and lower corner castings of the stacked containers and the twist-lock and the hook are each in the closed position within the corner casting.

2. The locking device according to claim 1, wherein a horizontal distance between a distal side of the lower portion of the housing and a free end of the hook is less than a longitudinal length of the ISO aperture; and the distance between diagonally opposite corners of the lower portion of the housing is less than a width of the ISO aperture;

wherein the lock device can be removed from the lower container when engaged by lifting the lower shear block up from the corner castings of the lower container and then turning the locking device so that a longitudinal length of the hook lies along the length of the ISO aperture.

3. The locking device according to claim 2, wherein the diagonally opposite corners each are a section of a circle.

4. The locking device according to claim 1, wherein the compression pad has an extension portion having a longitudinal length transverse to the longitudinal length of the shear blocks and extends out past edges of the corner castings when engaged.

5. The locking device according to claim 4, having means for rotating the twist-head from the closed to the open position extending through the extension portion.

6. The locking device according to claim 5, wherein said means include a handle engaged by a cable to a base of the twist-head within the housing.

7. The locking device according to claim 6, wherein the cable is located within the extension portion of the compression pad.

8. The locking device according to claim 7, wherein a swage is provided on the cable which can be engaged in a slot on the extension portion to maintain the twist-head in the open position.

9. The locking device according to claim 4, wherein an indicator is provided on the housing to alert an operator as to whether the hook is in the closed or open position, the indicator being slidably engaged within the extension portion of the compression pad by an indicator rod engaged to the hook.

10. A locking device adapted to be engaged in a conventional ISO aperture of a corner casting of an upper and lower shipping container stacked on a carrier to lock the containers together, the locking device comprising:

a housing having a compression pad and an upper and lower shear block fixed thereto;

a spring-biased twist-head engaged to the upper shear block rotatable in a horizontal plane against a first spring from a closed position to an open position, and a spring-biased hook engaged in the housing and rotatable around an axis in a vertical plane against a second spring from a closed position to an open position;

wherein the locking device can lock the containers together when the upper and lower shear block are respectively engaged in the ISO aperture of the upper and lower corner castings of the stacked containers and the twist-lock and the hook are each in the closed position within the corner casting.

11. The locking device according to claim 10, wherein the housing has a lower portion extending down from the lower shear block and the hook is rotatable through a slot in the lower shear block and the lower portion of the housing.

12. The locking device according to claim 11, wherein a horizontal distance between a distal side of the lower portion of the housing and a free end of the hook is less than a longitudinal length of the ISO aperture; and the distance between diagonally opposite corners of the lower portion of the housing is less than a width of the ISO aperture;

wherein the lock device can be removed from the lower container when engaged by lifting the lower shear block up from the corner castings of the lower container and then turning the locking device so that a longitudinal length of the hook lies along the length of the ISO aperture.

13. The locking device according to claim 12, wherein the diagonally opposite corners each are a section of a circle.

14. The locking device according to claim 10, wherein the compression pad has an extension portion having a longitudinal length transverse to the longitudinal length of the shear blocks and extends out past edges of the corner castings when engaged.

15. The locking device according to claim 14, having means for rotating the twist-head from the closed to the open position extending through the extension portion.

16. The locking device according to claim 15, wherein said means include a handle engaged by a cable to a base of the twist-head within the housing.

17. The locking device according to claim 16, wherein the cable is located within the extension portion of the compression pad.

18. The locking device according to claim 17, wherein a swage is provided on the cable which can be engaged in a slot on the extension portion to maintain the twist-head in the open position.

19. The locking device according to claim 14, wherein an indicator is provided on the housing to alert an operator as to whether the hook is in the closed or open position, the indicator being slidably engaged within the extension portion of the compression pad by an indicator rod engaged to the hook.

* * * * *